US005743802A

United States Patent [19]

Shives

[11] Patent Number: 5,743,802

[45] Date of Patent: Apr. 28, 1998

[54] WING SWING SEAT AND SWING DEVICE

[76] Inventor: Dennis Eugene Shives, 1272 Rice Rd., Ojai, Calif. 93023

[21] Appl. No.: 767,365

[22] Filed: Dec. 16, 1996

Related U.S. Application Data

[60] Provisional application No. 60/009,829, Jan. 16, 1996.

[51] Int. Cl. [6] ..... A63G 9/10

[52] U.S. Cl. ..... 472/118

[58] Field of Search ..... 472/118–125, 133; 297/273, 274; D21/246

[56] References Cited

U.S. PATENT DOCUMENTS

| | | | |
|---|---|---|---|
| D. 76,611 | 10/1928 | Ferris . | |
| 2,781,528 | 2/1957 | Lo Vico | 5/122 |
| 3,588,021 | 6/1971 | Wormser . | |
| 4,084,812 | 4/1978 | Melrose et al. . | |
| 4,188,063 | 2/1980 | Dusart | 297/273 |
| 4,198,045 | 4/1980 | Miller | 5/122 |
| 4,575,073 | 3/1986 | Thacker | 472/118 |
| 4,706,952 | 11/1987 | Shannon et al. . | |
| 5,197,925 | 3/1993 | Cunard . | |
| 5,338,260 | 8/1994 | Smith . | |

FOREIGN PATENT DOCUMENTS 2 040 697 9/1980 United Kingdom .

*Primary Examiner*—Kien T. Nguyen
*Attorney, Agent, or Firm*—Richard C. Litman

[57] ABSTRACT

A winged swing seat and swing combination device for any playground or yard swing. The swing seat device has two simulated wings extending from opposite sides of the seat. Each wing is equipped with attachment device for attaching a rope or chain for suspending the winged swing seat device. The swing seat device can be suspended from a horizontal tree limb or a beam. The swing seat device can be operated as a traditional swing with the operator sitting in the seat or as a belly swing with the operator placing one's abdomen on the seat of the swing.

20 Claims, 3 Drawing Sheets

WING SWING SEAT AND SWING DEVICE

CROSS-REFERENCE TO RELATED APPLICATION

This application claims the benefit of U.S. Provisional Patent application Ser. No. 60/009,829, filed Jan. 16, 1996.

BACKGROUND OF THE INVENTION

1. Field of the Invention

The present invention relates to playground and yard swings. This invention is a swing seat equipped with a pair of wings in assorted configurations to aid a child or person to pretend that he or she is flying when suspended from a horizontal tree limb or a beam.

2. Description of Prior Art

The prior art describes flexible linear swing seats and non-flexible swing seats which can be used to simulate or aid a child in pretending that they are flying.

Design U.S. Pat. No. 76,611 issued on Oct. 16, 1928, to Howard J. Ferris, describes a rigid aeroplane-shaped swing. The swing is suspended from four support ropes of which two ropes looped around both ends of the aeroplane are joined to a pair of parallel vertical ropes. The aeroplane has two seats and an intermediate foot rest to accommodate two persons. The two end support ropes pass freely through holes in the seats and support the fuselage without any fixation. The present invention permits flexibility of the swing seat for accommodating either sitting or lying down in a prone position on the seat.

U.S. Pat. No. 3,588,021 issued on Jun. 28, 1971, to Robert S. Wormser describes an adapter device for swings and playground equipment which attaches the swing to the supporting rope or chain. The adapter allows a cantilevered playground device such as a molded chicken with a seat and a footrest to be utilized as a swing without modification to the device itself. There is no suggestion for attachment to a flexible swing seat.

United Kingdom Application No. 2,040,697. A published on Sep. 3, 1980, for Ann E. Thomas describes a swing and a frame from which the swing is suspended. The swing is essentially formed from nylon webbing of various widths for the suspension and the wider rectangular seat which is reinforced with stitched on nylon webbing strips. The invention is based on the use of soft materials to reduce injuries in the event of a collision. There is no suggestion for the extension of the seat ends for any purpose as in the present invention.

U.S. Pat. No. 5,197,925 issued on Mar. 30, 1993, to Joel C. Cunard describes a rectangular swing seat molded from rubber or polyethylene. The swing seat has two parallel tubes extending along the underside of the swing. Each tube houses a chain running along the length of the swing and providing support to the swing seat. The chains in the tubes are attached to hangers which are sheathed for gripping and connect the swing seat to a pair of suspension chains. There is no suggestion for extending the seat ends beyond the hanger locations.

U.S. Pat. No. 4,084,812 issued on Apr. 18, 1978, to Kendrick B. Melrose et al. describes a playground swing support apparatus having a plurality of conventional swings surrounding a target object which the swings contact as a play activity. The swing seat is made of a flexible rubber-like or vinyl material which may be reinforced with steel or wire as a strengthening agent. The swing has a hole in both ends which is used to attach the swing to a rope or chain. The hole is surrounded by a metal casing to reinforce the hole and evenly distribute any stress around the hole. No extension of the ends of the swing seat is suggested for any reason.

U.S. Pat. No. 4,706,952 issued on Nov. 17, 1987, to William H. Shannon et al. describes a molded rubber swing seat with a stiff flat insert of spring steel supported further with three underlying parallel strands of steel wire, rope or cable to add form and strength to the swing seat. The swing seat has connecting fittings with S-hooks on the ends for securing a rope or chain. No suggestion for extending the seat ends beyond the fittings is seen.

U.S. Pat. No. 5,338,260 issued on Aug. 16, 1994, to Stephen W. Smith describes a swing with a rigid, upwardly curved seat. A chain extends along a longitudinal channel having interference fittings which limit any shifting of the seat. The chain exits the seat through openings on opposite ends of the seat to suspend the swing from a crossbar. There is no suggestion for extending the ends of the seat beyond the end openings.

None of the above inventions and patents, taken either singly or in combination, is seen to describe the instant invention as claimed.

SUMMARY OF THE INVENTION

Accordingly, it is the principal object of this invention to provide a swing seat device that will provide the appearance of an operator having wings and able to fly.

It is a further object of the invention to provide a device that will help foster the imagination of a child or adult, while also encouraging physical activity.

It is another object of the invention to provide a swing seat device that may be operated both as belly swing and a traditional swing which is sat upon.

It is still another object of the invention to provide a swing seat device which is easily installed in existing playgrounds and backyards.

In sum, children and adults can enjoy the use of a flying animal, insect, plane, projectile or the like when swinging in a recreation area or in their backyard. An additional psychological boost to the rider is available when the wings oscillate while the rider is either sitting or lying prone on one's abdomen on the winged swing seat.

It is yet another object of this invention to provide improved elements and arrangements thereof in an apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
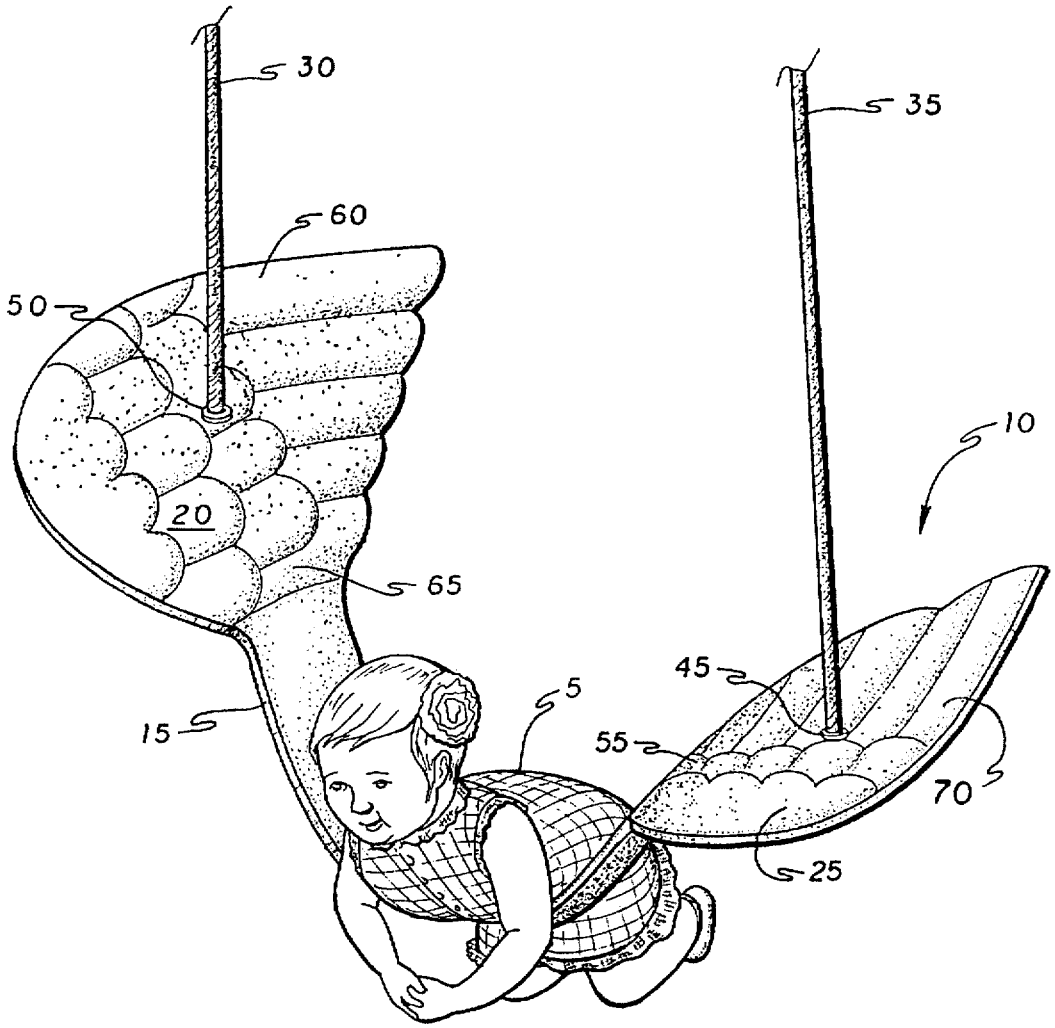
FIG. 1 is an environmental perspective view of a first embodiment of the invention, showing a child lying prone in the winged swing seat device, wherein the wings are shaped as angel wings.
Figure 4:
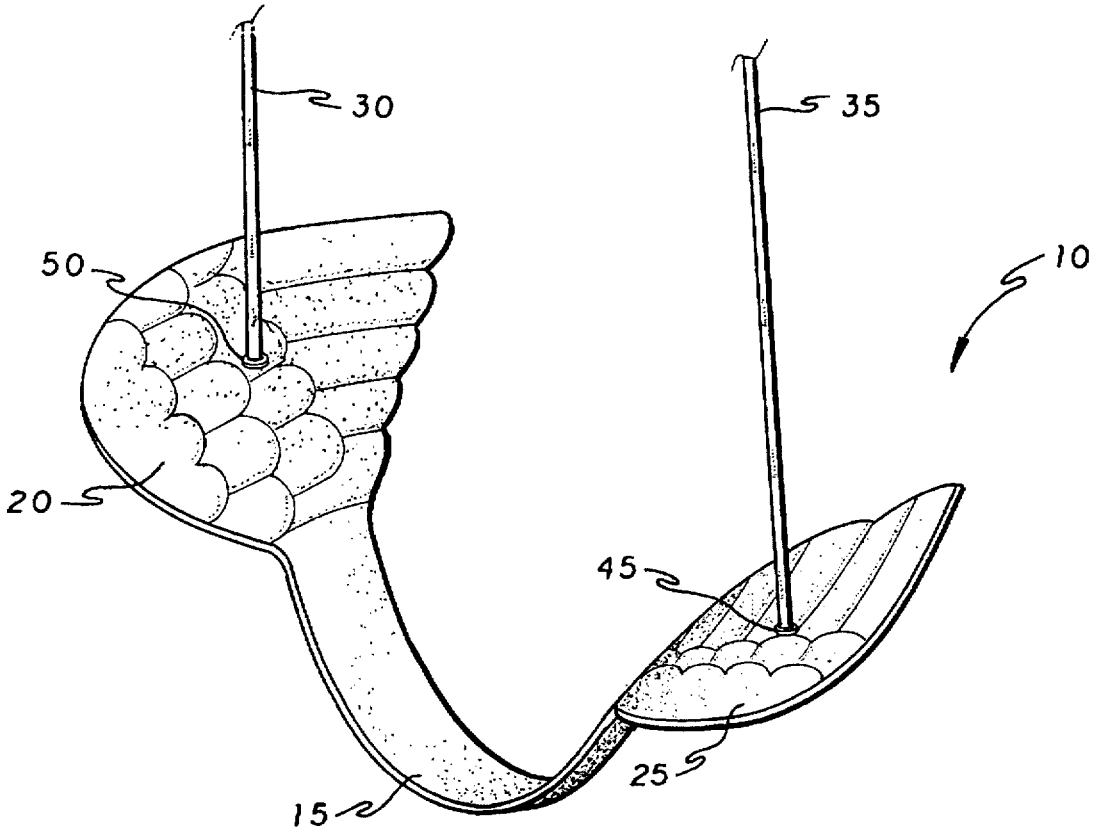
FIG. 4 is a perspective view of the first embodiment of the invention as seen in FIG. 1 without the operator.

In the first embodiment as shown in FIGS. 1 and 4, the winged swing seat device 10 is an apparatus that can be used as a play toy by children and even adults. The swing seat device is an embellishment to aid a child 5 in imagining that one is flying while swinging to-and-fro. The winged swing seat device 10 has a seat portion 15 to support the weight of the child or person. The swing seat device 10 has a right wing 20 and a left wing 25, each wing having a first end extending from opposite sides of the seat portion 15 and a second end. The swing seat device 10 may be used as a traditional swing with a operator sitting on the seat 15 or as a belly swing with the operator lying prone by placing the stomach on the seat portion 15, so that the wings 20, 25 of the swing seat device appear to be extending from the back of the operator.

FIG. 1 shows a perspective view of a female child 5 operating the winged swing seat device 10 as a belly swing. The swing seat device 10 is suspended from a horizontal tree limb or beam (not shown) by right and left suspension means 30, 35, respectively, which can be ropes, wires, chains, elastic cords or rubber cords attached proximate to the second ends of wings 20, 25.

The angel wings 20, 25 in FIG. 1 are to be considered exemplary. The wings of the present invention can take the form of any type of wings, such as, for example, a bat (FIG. 2), a bird (FIG. 3) or others not depicted such as a butterfly, a bee, a pterodactyl, an airplane, a space shuttle or a winged animal such as a winged horse.

Figure 2:
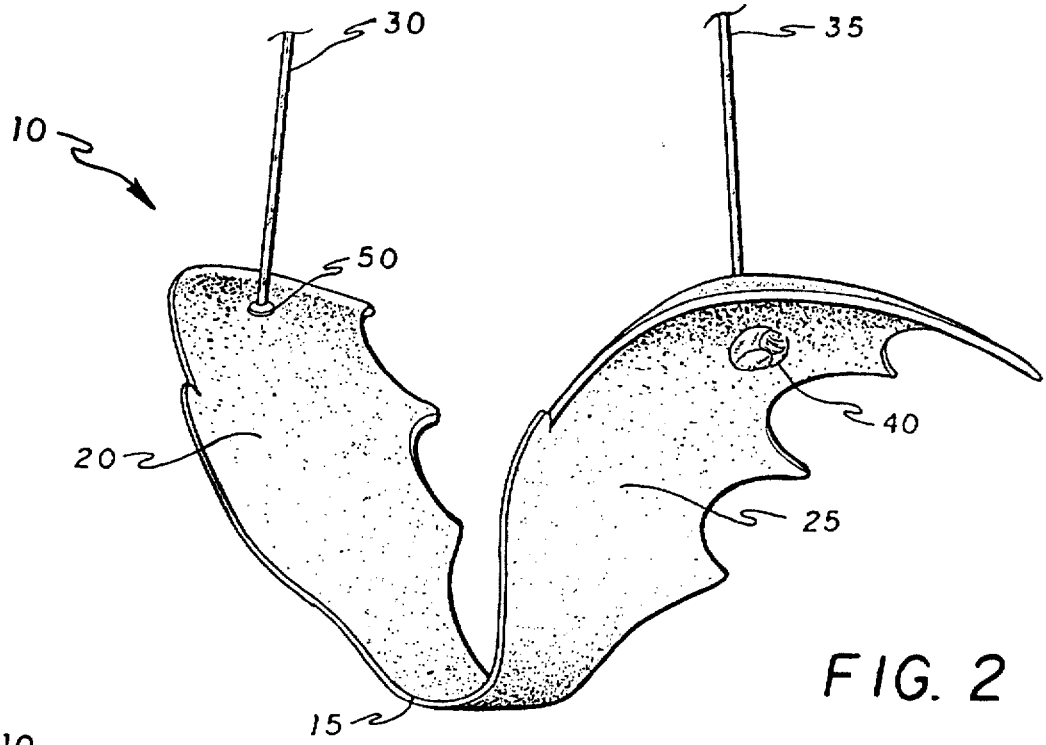
FIG. 2 is a perspective view of a second embodiment of the invention, illustrating the winged swing seat device with the wings shaped in the form of bat wings.
Figure 3:
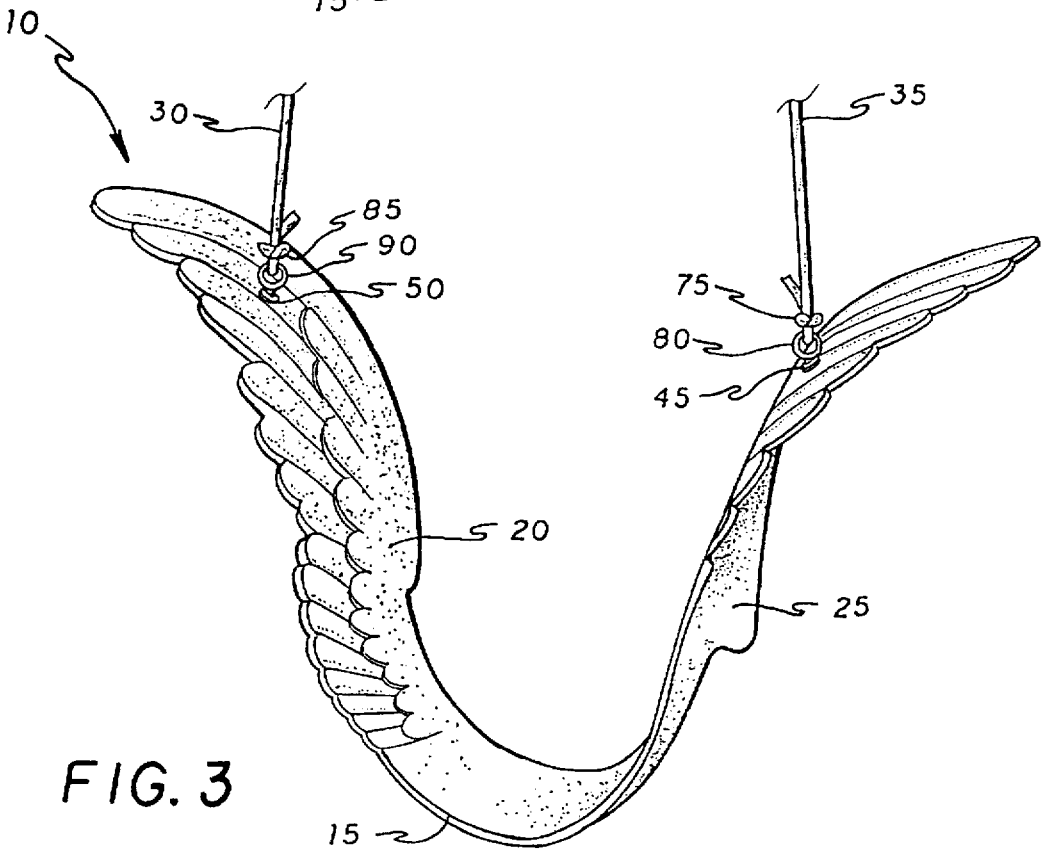
FIG. 3 is a perspective view of a third embodiment of the invention, illustrating the winged swing seat device the wings shaped in the form of bird wings.

FIGS. 2 and 3 are perspective views of several different types of wings configurations that are possible for the winged swing seat device 10. The finer feather details of the wings can be embedded or raised on to the surface of the wings 20, 25. In this manner, the feathers of angel wings or bird wings may be shown.

The winged swing seat device 10 may be operated by a child or adult in either of two modes of operation. In the first mode, the child or adult may sit on the seat 15 of the winged swing seat device 10. In this sitting position, the child or adult may sway backward and forward in the seat 15 of swing 10 to induce a swinging motion. The child or adult may also sit in the seat 15, and be pushed by another person to create the swinging motion. The second mode of operation for the winged swing would be for the child or adult to place the abdomen on the seat 15 in a prone position, as seen in FIG. 1. The child or adult can induce the swinging motion by pushing off with his or her legs and feet or by being pushed by another person. In this position the wings appear to be extending from the back of the child or person, and the rider can aesthetically experience the flying or gliding motion of a flier.

The winged swing seat device 10 may be made from any type of material. The wings 20, 25 and seat 15 can be made from the same type of material or separate materials. Preferably, the wings 20, 25 are made from an elastic plastic or rubber material. The elastic material can be reinforced with wires or chains (not shown) to provide additional support to the seat. The winged swing seat device 10 can also be made of a stiff material, such as plastic, so that the wings are fixed to a preset orientation to the seat.

The winged swing seat device 10 can be suspended from a horizontal beam or a tree limb. The suspension means are attached to the swing through holes in the wings 20, 25. In the preferred embodiments shown in FIGS. 1–4, a pair of ropes 30 (right), 35 (left) are used as the suspension means. The ropes 30, 35 are attached to the winged swing seat device 10 by inserting a rope through each grommeted hole 45 (left) and 50 (right) in the wing and tying a knot 40 in the rope 30 or 35, so that the knot 40 is larger than the grommeted hole as depicted in FIG. 2 for the second embodiment of bat wings. The reinforced metal grommeted holes 45, 50 serve to reduce and distribute the stress exerted by the rope and rider on the wings of the swing seat device 10.

Other types of devices are available to secure the suspension means to the winged swing device 10. The selection of the proper securing device will depend on which suspension means is being used such as the knots 85 and 75 on eyebolts 90 and 80, respectively, as depicted in the third embodiment of FIG. 3 for bird wings.

The height of the winged swing 10 and the suspension means 30, 35 can be varied to accommodate the mode of operation of the swing seat device. When the winged swing seat device 10 is operated as a traditional swing, the suspension means 30, 35 should allow the bottom of the seat to be approximately two to three feet off the ground. This height will permit a child or adult to pull oneself into and out of the swing seat device. When the winged swing seat device 10 is operated as a belly swing, the suspension means 30, 35 should be adjusted to allow the bottom of the seat to rest approximately at the waist of the child or adult. This will allow rider to easily place one's stomach onto the swing seat portion 15 and push with one's feet and legs to induce the swinging motion.

The suspension means 30, 35 may be attached to any part of the respective wings 20, 25. Each wing 20, 25 has a first end 65, 55 and a second end 60, 70, respectively. The first ends 55, 65 of each wing is attached to the seat 15. When the suspension means 30, 35 are attached proximate the first ends 55, 65 of each wing at a predetermined distance, and the wings 20, 25 are constructed from an elastic material, then the wings 20, 25 will oscillate during operation and simulate flapping wings. The suspension means 30, 35 can also be attached to near the second end 60, 70 of the wings 20, 25, respectively, so that the wings 20, 25 act as a side support for the occupant of the winged swing seat device 10.

The wings 20, 25 can be constructed with a single hole at the desired location or with multiple holes(not shown), so that the operator may change the position to suit his or her mood or imagination. When very large wings 20, 25 are desired, then additional suspension means may be connected to the alternative holes to help support the weight of the wings.

The winged swing seat device 10 is a playground toy which will help a child or an adult pretend that they are flying. The winged swing seat device fosters the imagination of a child, especially, and encourages physical activity. The swing seat device 10 has two oscillating wings 20, 25 extending from opposite ends of the seat 15 to help a child visualize an imaginary flight. The winged swing seat device 10 can be suspended from a horizontal tree limb or a beam, and can function as a traditional sitting swing or as a belly positioned swing.

It is to be understood that the present invention is not limited to the embodiments described above, but encompasses any and all embodiments within the scope of the following claims.

I claim:

1. A winged swing seat device comprising:

a pair of wide flexible wings, each wing having a first end and a second end;

a narrow flexible seat bridging said first end of each wing; and an attachment means for attaching a suspension means to each said wing, said attachment means located between said first end and said second end of each said wing and proximate a predetermined distance from said first end of each said flexible wing for oscillation of said pair of wide flexible wings while swinging to enhance a sensation of flight.

2. The winged swing seat device according to claim 1, wherein said pair of flexible wings have the shape of angel wings.

3. The winged swing seat device according to claim 1, wherein said pair of flexible wings have the shape of bird wings.

4. The winged swing seat device according to claim 1, wherein said pair of flexible wings have the shape of bat wings.

5. The winged swing seat device according to claim 1, wherein said pair of flexible wings have the shape of pterodactyl wings.

6. The winged swing seat device according to claim 1, wherein said pair of flexible wings have the shape of butterfly wings.

7. The winged swing seat device according to claim 1, wherein said pair of flexible wings have the shape of airplane wings.

8. The winged swing seat device according to claim 1, wherein said pair of flexible wings have the shape of space shuttle wings.

9. The winged swing seat device according to claim 1, wherein said attachment means for attaching a suspension means comprises a grommeted hole in each of said pair of flexible wings.

10. The winged swing seat device according to claim 1, wherein said attachment means for attaching a suspension means comprises an eyebolt in each of said pair of flexible wings.

11. A winged swing seat and swing combination device comprising:

a pair of wide flexible wings, each wing having a first end and a second end;

a narrow flexible seat bridging said first end of each wing;

an attachment means for attaching a suspension means to each said wing, said attachment means located between said first end and said second end of each said wing and proximate a predetermined distance from each said first end of said pair of flexible wings for oscillation of said pair of flexible wings; and said suspensions means being attached to a horizontal supporting structure selected from a tree limb and a beam, whereby oscillation of said pair of flexible wings can be effected while swinging to enhance the sensation of flight.

12. The swing combination device according to claim 11, wherein the suspension means is a material selected from the group consisting of a rope, a wire, a chain, an elastic cord, and a rubber cord.

13. The swing combination device according to claim 11, wherein said pair of flexible wings have the shape of angel wings.

14. The swing combination device according to claim 11, wherein said pair of flexible wings have the shape of bird wings.

15. The swing combination device according to claim 11, wherein said pair of flexible wings have the shape of bat wings.

16. The swing combination device according to claim 11, wherein said pair of flexible wings have the shape of pterodactyl wings.

17. The swing combination device according to claim 11, wherein said pair of flexible wings have the shape of airplane wings.

18. The swing combination device according to claim 11, wherein said pair of flexible wings have the shape of space shuttle wings.

19. The swing combination device according to claim 11, wherein said attachment means for attaching a suspension means comprises grommeted holes.

20. The swing combination device according to claim 11, wherein said attachment means for attaching a suspension means comprises eyebolts.

* * * * *